US008465402B2

(12) United States Patent
Ehmann et al.

(10) Patent No.: US 8,465,402 B2
(45) Date of Patent: Jun. 18, 2013

(54) EXERCISE DEVICE

(76) Inventors: Ryan J. Ehmann, Mead, CO (US); Shawn R. Alstad, Peoria, AZ (US)

( * ) Notice: Subject to any disclaimer, the term of this patent is extended or adjusted under 35 U.S.C. 154(b) by 420 days.

(21) Appl. No.: 12/855,520

(22) Filed: Aug. 12, 2010

(65) Prior Publication Data

US 2011/0039666 A1 Feb. 17, 2011

Related U.S. Application Data

(60) Provisional application No. 61/233,759, filed on Aug. 13, 2009.

(51) Int. Cl.
*A63B 21/04* (2006.01)
*A63B 26/00* (2006.01)

(52) U.S. Cl.
USPC ..... 482/140; 482/142

(58) Field of Classification Search
USPC ..... 482/121–130, 70–72, 93, 140
See application file for complete search history.

(56) References Cited

U.S. PATENT DOCUMENTS 3,583,322 A * 6/1971 Vykukal ..... 104/307
4,645,201 A * 2/1987 Evans ..... 482/70
4,650,184 A * 3/1987 Brebner ..... 482/71
4,813,667 A * 3/1989 Watterson ..... 482/70
5,029,848 A * 7/1991 Sleamaker ..... 482/96
5,354,251 A * 10/1994 Sleamaker ..... 482/96
5,499,961 A * 3/1996 Mattox ..... 482/132
5,827,158 A * 10/1998 Drecksel ..... 482/96
5,921,900 A * 7/1999 Mankovitz ..... 482/121
6,001,051 A * 12/1999 Chuan-Pin ..... 482/131
6,071,217 A * 6/2000 Barnett ..... 482/121
6,500,105 B1 * 12/2002 Kuo ..... 482/123
6,811,517 B1 * 11/2004 Eschenbach ..... 482/52
6,890,288 B2 * 5/2005 Bingham ..... 482/69
7,204,790 B2 * 4/2007 Sleamaker ..... 482/96
7,462,138 B2 * 12/2008 Shetty et al. ..... 482/69
D584,367 S * 1/2009 Augustine et al. ..... D21/662
7,556,592 B2 * 7/2009 Nizam ..... 482/70
7,645,218 B2 * 1/2010 Potok ..... 482/141
7,682,294 B2 * 3/2010 Piane, Jr. ..... 482/97
7,780,585 B1 * 8/2010 Rivas ..... 482/140
7,883,450 B2 * 2/2011 Hidler ..... 482/69
7,993,248 B1 * 8/2011 Rasmussen ..... 482/69
7,998,038 B2 * 8/2011 Keiser ..... 482/112
D659,777 S * 5/2012 Watterson et al. ..... D21/689
8,241,186 B2 * 8/2012 Brodess et al. ..... 482/52
2006/0183606 A1 * 8/2006 Parmater ..... 482/72
2008/0242519 A1 * 10/2008 Parmater ..... 482/72
2012/0094812 A1 * 4/2012 Smiley ..... 482/128

* cited by examiner

*Primary Examiner* — Stephen Crow
(74) *Attorney, Agent, or Firm* — Griffiths & Seaton PLLC

(57) ABSTRACT

Various device and method embodiments for an exercise device are provided. In one such embodiment, the exercise device includes a trolley. The trolley includes at least one peg connected to the trolley, the at least one peg adapted to make contact with at least a portion of a user's foot. The exercise device also includes a shaft supported in an angled position to accommodate the trolley. The trolley is adapted to be pulled along the shaft towards the user by the at least the portion of the user's foot while the user is in a seated position.

6 Claims, 10 Drawing Sheets

EXERCISE DEVICE

BACKGROUND OF THE INVENTION

1. Field of the Invention

The present invention relates in general to an exercise device, and more particularly to an exercise device with a trolley device for exercising the legs and upper body.

2. Description of the Prior Art

Exercise equipment is utilized in today's society for the enhancement and improvement of muscular strength, endurance, and overall physical and mental health. Many exercise devices, such as free weights, barbells, and dumbbells, are bulky and expensive. Failure to properly perform the intended exercise with these devices can result in significant injuries to the novice or inexperienced user. Over the years, progressive improvements to exercise equipment circumvent many of these dangers but often times are bulky, costly, and of great height. Other exercise devices require fixed and permanent installation absent any options for simple storage.

SUMMARY OF THE INVENTION

The focus of an exercise device should provide protection to the user, as well as providing a safe and trouble free operation. The present invention is an improved exercise device designed to be simple and easy for all users.

In view of the foregoing, a need exists for an exercise device having a trolley that is safe to use, easy to store, cost effective, and is transportable. Accordingly, various device and method embodiments for an exercise device are provided. In one embodiment, by way of example only, an exercise device is provided. The exercise device includes a trolley. The trolley includes at least one peg connected to the trolley, the at least one peg adapted to make contact with at least a portion of a user's foot. The exercise device also includes a shaft supported in an angled position to accommodate the trolley; wherein the trolley is adapted to be pulled along the shaft towards the user by the at least the portion of the user's foot while the user is in a seated position. Related device and method embodiments are also disclosed and provide additional advantages.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE DRAWINGS

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
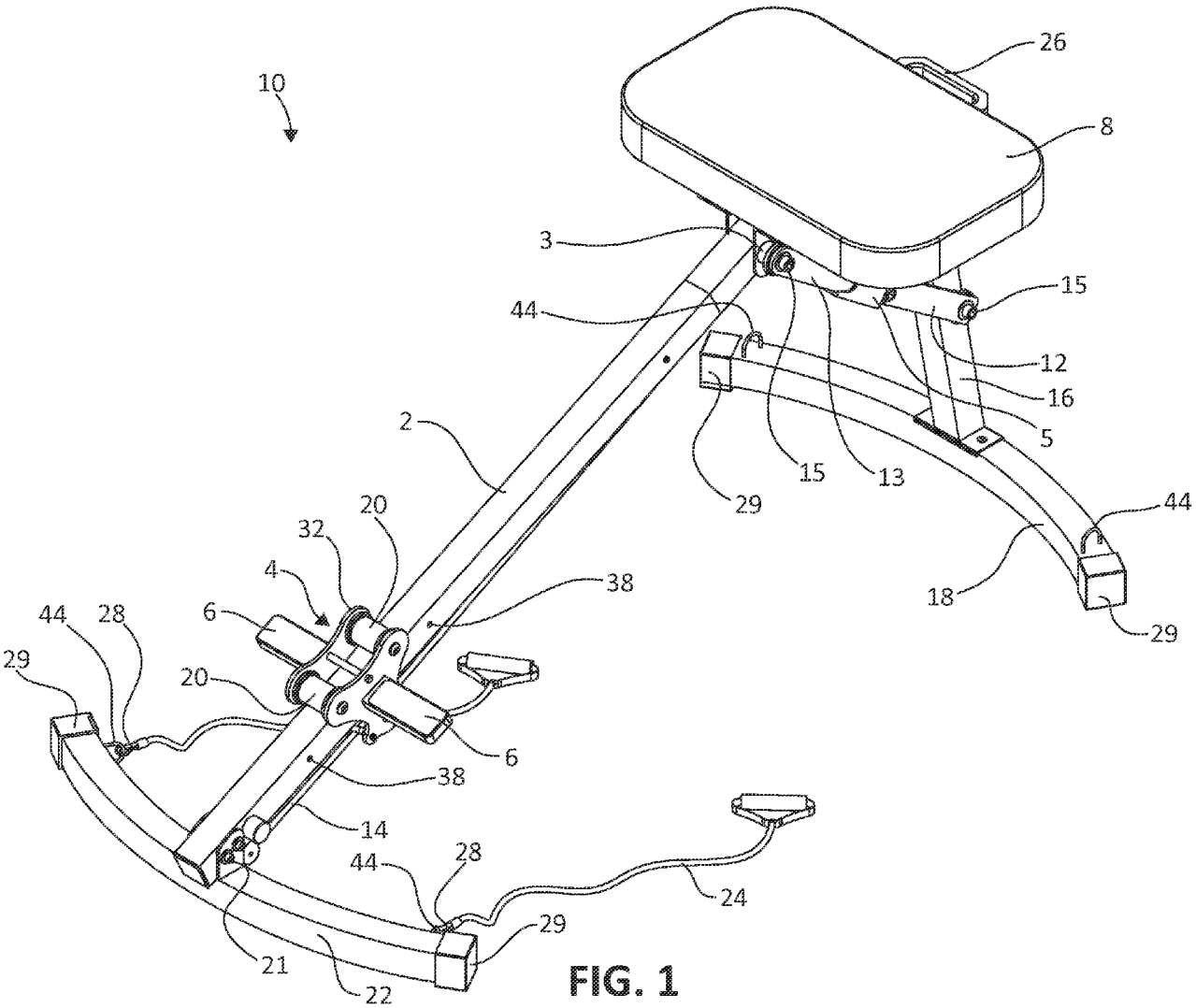
FIG. 1 illustrates an exemplary exercise device according to the present invention from a three dimensional side view.

Referring to FIG. 1, showing a three-dimensional side view, is a depiction of one example of an exercise device 10. The exercise device 10 may be composed of steel, iron, a high-strength lightweight alloy material, any metallic material, polyvinyl chloride (PVC) material, polyurethane material, a composite material such as a carbon fiber layup, polymer, a joint metallic and polyurethane material, or any other material known in the art suitable for such an application. One useful option for the composition of the exercise machine 10 may, for example, include carbon steel.

The shaft 2 is the central piece and backbone for strength, stability, and durability for the exercise device 10. The shaft 2 is connected to a front foot 22, a seat 8, a rear beam 16, and a collapsible beam 9 as shown. The shaft 2, front foot 22, rear foot 18, or the rear beam 16 may be of a variety of lengths, shapes and sizes, depending upon the users needs. One useful option for the shaft 2 may include either a straight or curved shaft with very strong and rigid 1.50"×1.50" inch square steel tubing resistant to the wear and tear of the motion of the trolley 4.

In one embodiment, the seat 8 may be a large, stable, and comfortable seat 8, semi-permanently or permanently connected to the rear end of the shaft 2. The seat 8 may be of any type of rubber, plastic, foam, fibrous substance, cloth, synthetic material, or any other type of material known in the art, which are suitable for such an application.

In one embodiment, the shaft 2 has a front end and a rear end. The front end is attached via a connection device 21 to a front foot 22 for stability and stabilization. The connection device 21 may include angled brackets, mounting clamps, or other type of connection devices known in the art for attaching structures together, and may be a separate component or as a permanent structure to either the shaft 2 or the front foot 22.

In one embodiment, the exercise device 10 allows the trolley 4 to roll along the shaft 2 in a forward, backward, upward, downward, or any other directional motion. The trolley 4 consists of a peg 6 connected to the vertical plates 32. Multiple pegs 6 may connect to the trolley 4. The trolley 4 may include adding additional free or external weights to the peg 6. Each of the vertical plates 32 are placed on opposite sides of the shaft 2. The wheels 20 of the trolley 4 are connected to each of the vertical plates 32. One useful option may include two wheels 20 connected to upper portion of the vertical plates 32. The trolley 4 third wheels 20 may connect to each of the lower portion of the vertical plates 32 and be underneath the shaft 2. The two top wheels 20 of the trolley 4 may span the width of the shaft 2 and roll along the top of the shaft 2. The third wheels 20 of the trolley 4, located on the lower portion of the vertical plates 32, may also span the width of the shaft 2 but may or may not come in contact and roll along the shaft 2. The shaft 2 includes various openings 38 allowing for the use of a ball lock pin, or other device commonly known in the art, allowing the trolley 4 to be positioned along the shaft 2 in various locations to accommodate various users' leg lengths. The various openings 38 may be placed throughout the shaft 2 and may include multiple various openings 38.

In one embodiment, the peg 6 allows the user to place on, beneath, inside, above, or securely fix the users feet to the peg 6 to pull the trolley 4 along the shaft. The peg 6 may include attachment devices, such as Velcro®, straps, pedals, or other devices to fix to users feet onto the peg 6. One useful option may include the shaft 2 angled upwards towards the user, and with the users feet on the peg 6 of the trolley 4, pull the trolley 4 along the shaft 2 upwards along the shaft 2 until the shaft 2 reaches a desired ending position or the top of the shaft 2. Once the trolley 4 is at the peak or furthest closest position to the user, the trolley 4 may stop and roll down the angled shaft 2 to the original starting position for another repetition. For example, the trolley 4 may roll down the shaft by gravity, the flexible cord 14, the users feet, or a combination of gravity, the flexible cord 14, and the users feet.

In one embodiment, the rear end of the shaft 2 is connected, by a bolt 15, to the seat 8 and the collapsible beam 9. The bolt 15 may include any connective means such as a bolt, nail, screw, pin, rod, or other device commonly used in the art for connection. The collapsible beam 9 contains both an upper collapsible beam 13 and a lower collapsible beam 12. The upper collapsible beam 13 connects to the shaft 2 while the lower collapsible beam 12 connects to the rear beam 16. The collapsible beam 9 may either be designed as one singular piece, or the collapsible beam 9 may centrally connect two separate attachment pieces, by means of the bolt 15 located in the center of the collapsible beam 9, so as to allow the collapsible beam 9 to pivot, extend, and collapse. Either as a singular piece or two separate pieces, the collapsible beam 9 may pivot, extend, or collapse. A slider 5 is a mechanism used to lock the collapsible beam 9 when the machine is in a set up, a ready, or an upright position. The slider 5 is capable of sliding along the collapsible beam 9. The slider 5 may be a coupling device or housing device that surrounds the collapsible beam 9. When the slider 5 is over the bolt 15 in a locked position, the collapsible beam 9 is unable to pivot, bend, or collapse. In other words, when the collapsible beam 9 is in a substantially straightened position, the slider 5 may slide along the collapsible beam 9 and be set to a locked position over the bolt 15, which is located in the center of the collapsible beam 9. The locked position of the slider 5 allows the user to be in a seated position on the exercise device 10 with the shaft 2 in an angled position and the rear beam 16 in an upright position to stabilize and support the exercise device 10.

Hooks 28 are attached to rings 44 which are secured to the front foot 22 and rear foot 18. The hooks 28 attach to the rings 44 providing the option for flexible hand held cords 24 to be used by the user's hands for additional support, resistance, stability, exercise or other various needs for using the exercise device 10. Additional features, as described in earlier figures, are also depicted as illustrated examples.

Turning to FIG. 2, in one embodiment, again the exercise device includes a shaft 2 with a trolley 4 for rolling along the shaft 2. The rear or right end of the shaft 2 is connected to the seat 8 and the collapsible beam 9 by a bolt 15. The collapsible beam 9 contains both an upper collapsible beam 13 and a lower collapsible beam 12. The upper collapsible beam 13 connects to the shaft 2 and the lower collapsible beam 12 connects to the rear beam 16. The collapsible beam 9 may either be one piece or the collapsible beam 9 may centrally connect two separate attachment pieces, by means of the bolt 15, the bolt 15 being any connective means such as a bolt, nail, screw, pin, rod, or other device commonly used in the art for connection, so as to allow the collapsible beam 9 to pivot, extend, and collapse. The shaft 2 has a front or left end where the shaft 2 connects to the front foot 22 by a connection device 21.

Figure 2:
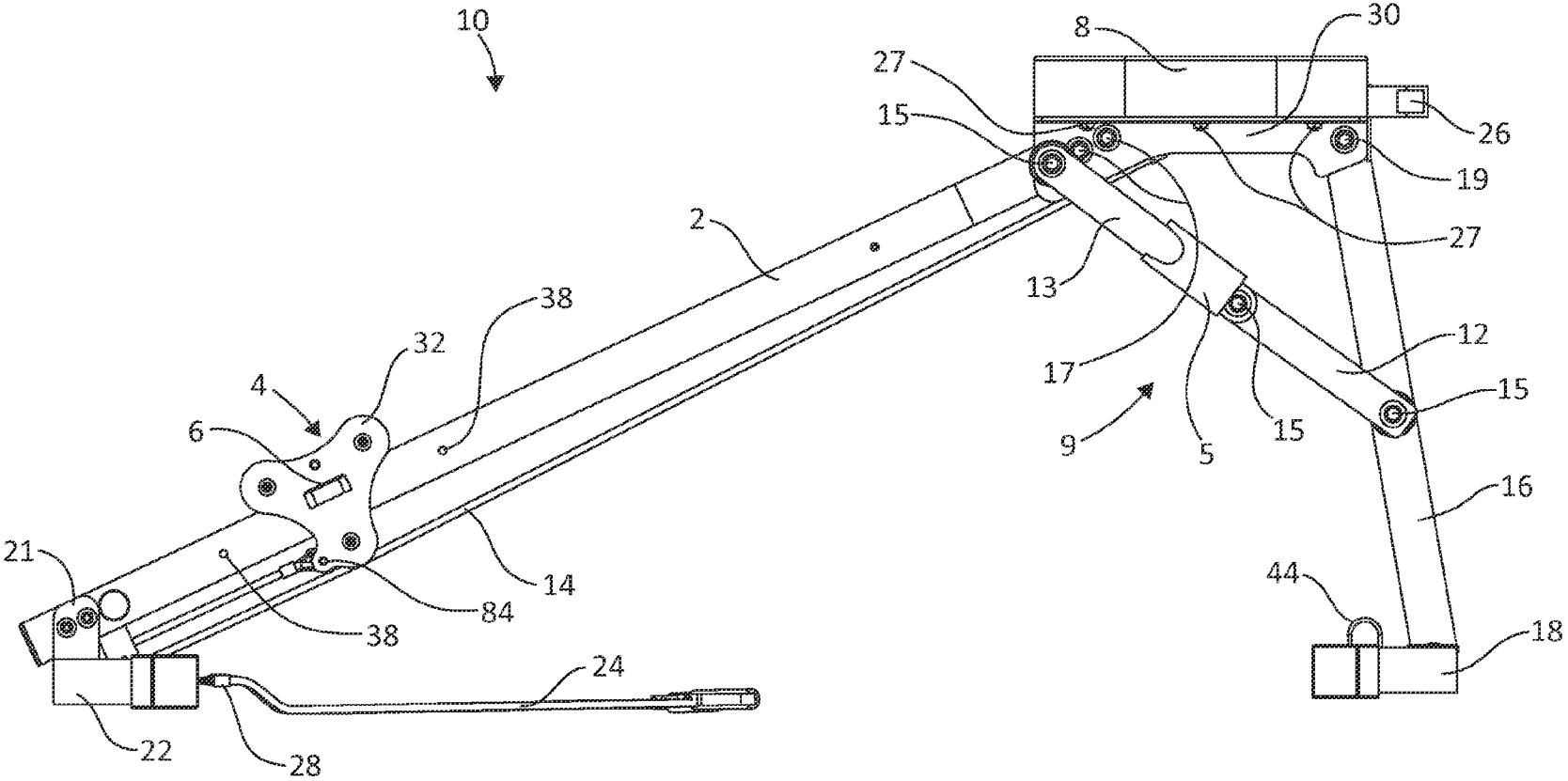
FIG. 2 illustrates an exemplary exercise device according to the present invention from a side view.

More clearly depicted in FIG. 2, is one example of several bolts 27 connecting the seat 8 to the attachment pieces 30 which connect to the shaft 2, the bolts 27 may be any connective means such as a bolt, nail, screw, pin, adhesive, or other device commonly used in the art for such connective purposes.

The front foot 22 may contain end caps 29 on each end to further provide security, stabilization, and protection of the exercise device 10. More clearly depicted is the flexible cord 14 which connects to the trolley 4. The flexible cord 14 may connect directly to either one or both of the vertical plates 32 or a connective pin 84 that is connected to the lower half of the vertical plates 32. One useful option provides for the connective pin 84 device to connect to the lower half of each of the vertical plates 32. The connective pin 84 may span the width, beneath the lower half, of the shaft 2. The exercise device 10 enables the user to select multiple flexible cords 14 or a single flexible cord 14 for resistance to vary the trolley 4 speed, resistance, stroke, and position. The flexible cord 14 is connected to a pulley 25 just underneath the shaft 2 near the connecting device 21. The flexible cord 14 rotates around the pulley 25 and travels back towards the right end of the shaft 2 to connect to the shaft 2 just underneath the shaft 2 and the seat 8. The flexible cord 14 may also use the lower wheels 20 of the trolley 4 as an additional pulley. Depending upon the amount of weight the trolley 4 supports, a slight gap between the bottom of the shaft 2 and the lower wheels 20 of the trolley 2 may exist. The lower wheels 20 of the trolley 4 may work also as an additional pulley for the flexible cord 14. For example, as the user is pulling the trolley 4 along the angled shaft 2 in an upward direction, the wheels 20 underneath the shaft 2 will spin in an opposite direction than the wheels 20 on the trolley 4 above the shaft 2. The wheels 20 of the trolley 4 underneath the shaft 2 will rotate, in the direction of the flexible cord 14, acting like a pulley.

In one embodiment, a side view of the collapsible beam 9 is more clearly observed. The upper collapsible beam 13 connects to the shaft 2 by the bolt 15, the bolt 15 being any connecting device such as a bolt, nail, screw, or other known adhesive commonly known in the art suitable for such purposes. The lower collapsible beam 12 is connected to the rear beam 16 with the bolt 15. In the center of the collapsible beam 9, the bolt 15 acts as a pivot structure allowing for the upper collapsible beam 13 and the lower collapsible beam 12 to rotate, pivot, extend, and pivotally move about the bolt 15. Additional features, as described in earlier figures, are also depicted as illustrated examples.

Figure 3A:
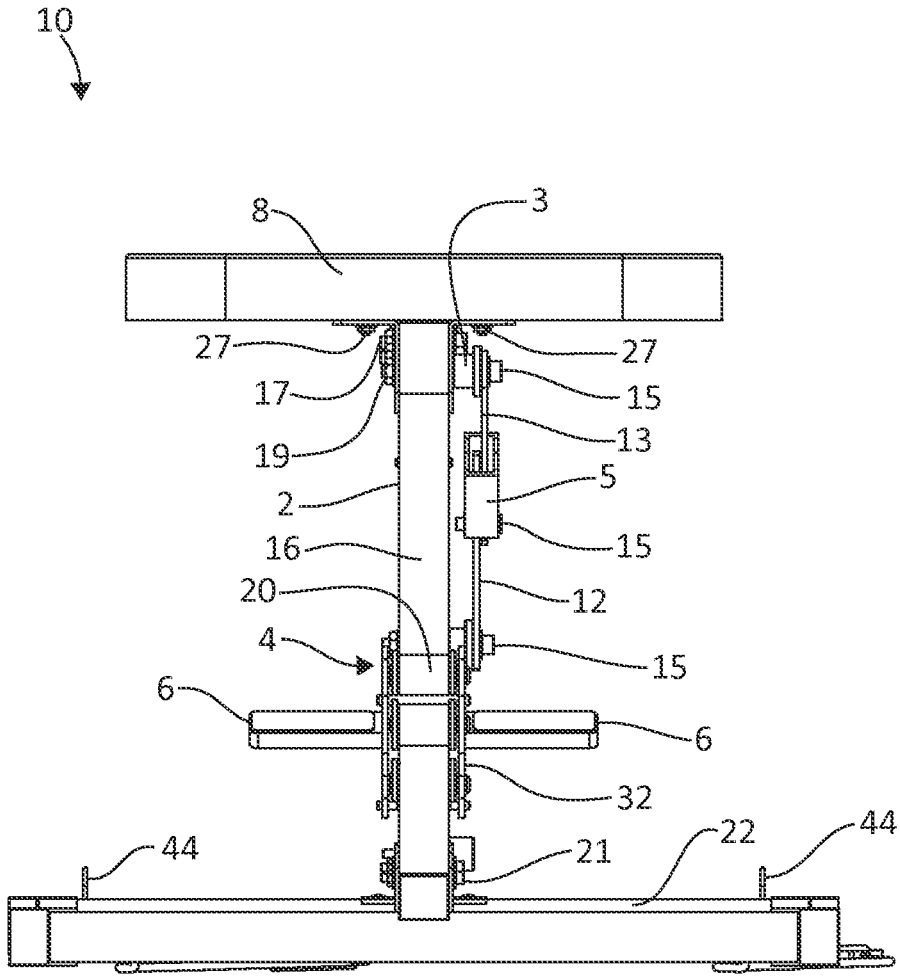
FIG. 3A illustrates an exemplary exercise device according to the present invention from a front view.
Figure 3B:
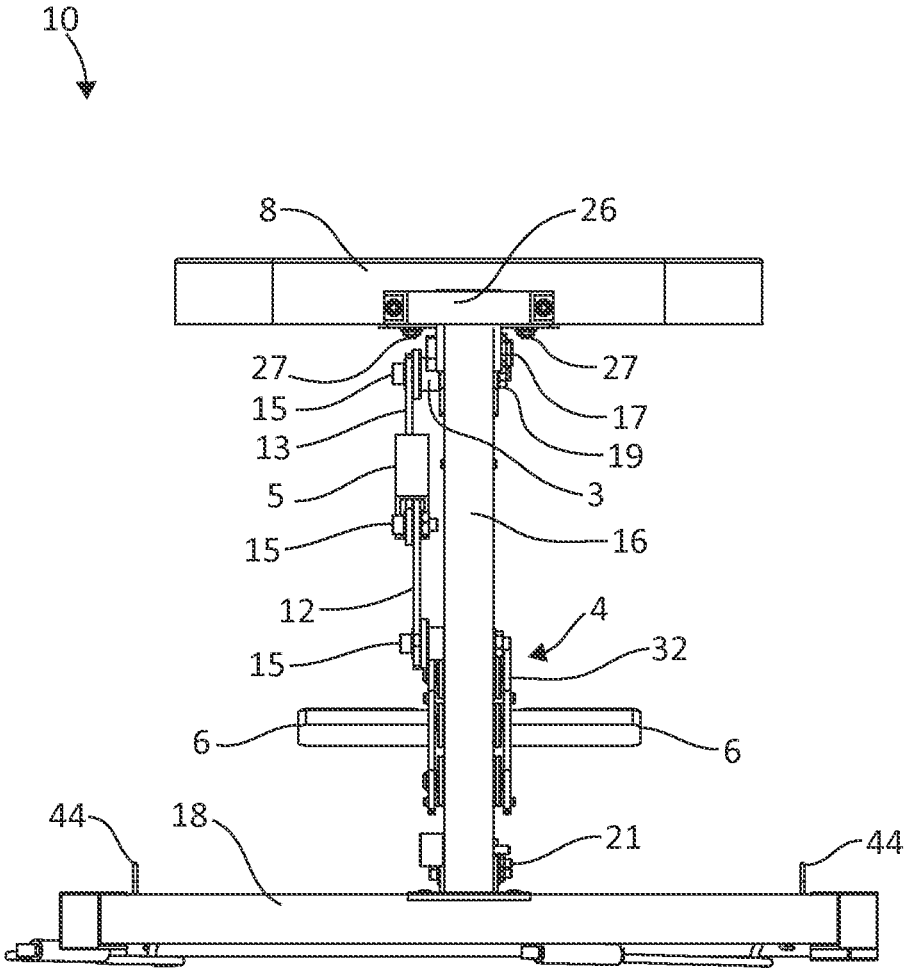
FIG. 3B illustrates an exemplary exercise device according to the present invention from a back view.

Turning to FIGS. 3A and 3B collectively, depicts more clearly the exercise device 10 in an exemplary embodiment from a front view, FIG. 3A, a side view FIG. 3B. As seen in both the front view and side view, in one embodiment, again the exercise device includes a shaft 2 with a trolley 4 for rolling along the shaft 2. The rear or right end of the shaft 2 is connected to the seat 8 and the collapsible beam 9 by a bolt 15. One example may include several bolts 27 connecting the seat 8 to the shaft 2, the bolts 27 being any connective means such as a bolt, nail, screw, pin, adhesive, or other device commonly used in the art for such connective purposes. The collapsible beam 9 may either be one piece or the collapsible beam 9 may centrally connect two separate attachment pieces, by means of the bolt 15, the bolt 15 being any connective means such as a bolt, nail, screw, pin, rod, or other device commonly used in the art for connection, so as to allow the collapsible beam 9 to pivot, extend, and collapse. The shaft 2 has a front or left end where the shaft 2 connects to the front foot 22 by a connection device 21.

In one example, both the front and side view illustrate that the collapsible beam 9, containing both the upper collapsible beam 13 and a lower collapsible beam 12 being connected to the shaft with the bolt 15, but a spacer 3 is utilized to provide a distance between the collapsible beam 9 and the shaft 2. The spacer 3 allows the collapsible beam 9 to extend, collapse, and for the slider 5 to move up and down the collapsible beam 9 without any contact with the shaft. The spacer 3 allows for the exercise device 10 to be set up or taken down with ease and simplicity. The spacer 3 may be of any type of material commonly used in the art for providing spacing and a buffer zone between the shaft and the upper collapsible beam 13 and the lower collapsible beam 12. The seat 8 also provides a seat handle 26 for gripping and holding on the to seat during exercise or for moving, lifting, holding, and transporting the exercise device 10.

In one exemplary embodiment, in both the front view and the side view, the wheels 20 of the trolley 4, which connect to the vertical plates 32, span the width of the shaft to a degree that vertical plates 32 are set out past the shaft 2. The spacing between the shaft and the vertical plates 32 allows for the trolley 4 to smoothly roll along the shaft. Additional features, as described in earlier figures, are also depicted as illustrated examples.

Figure 4:
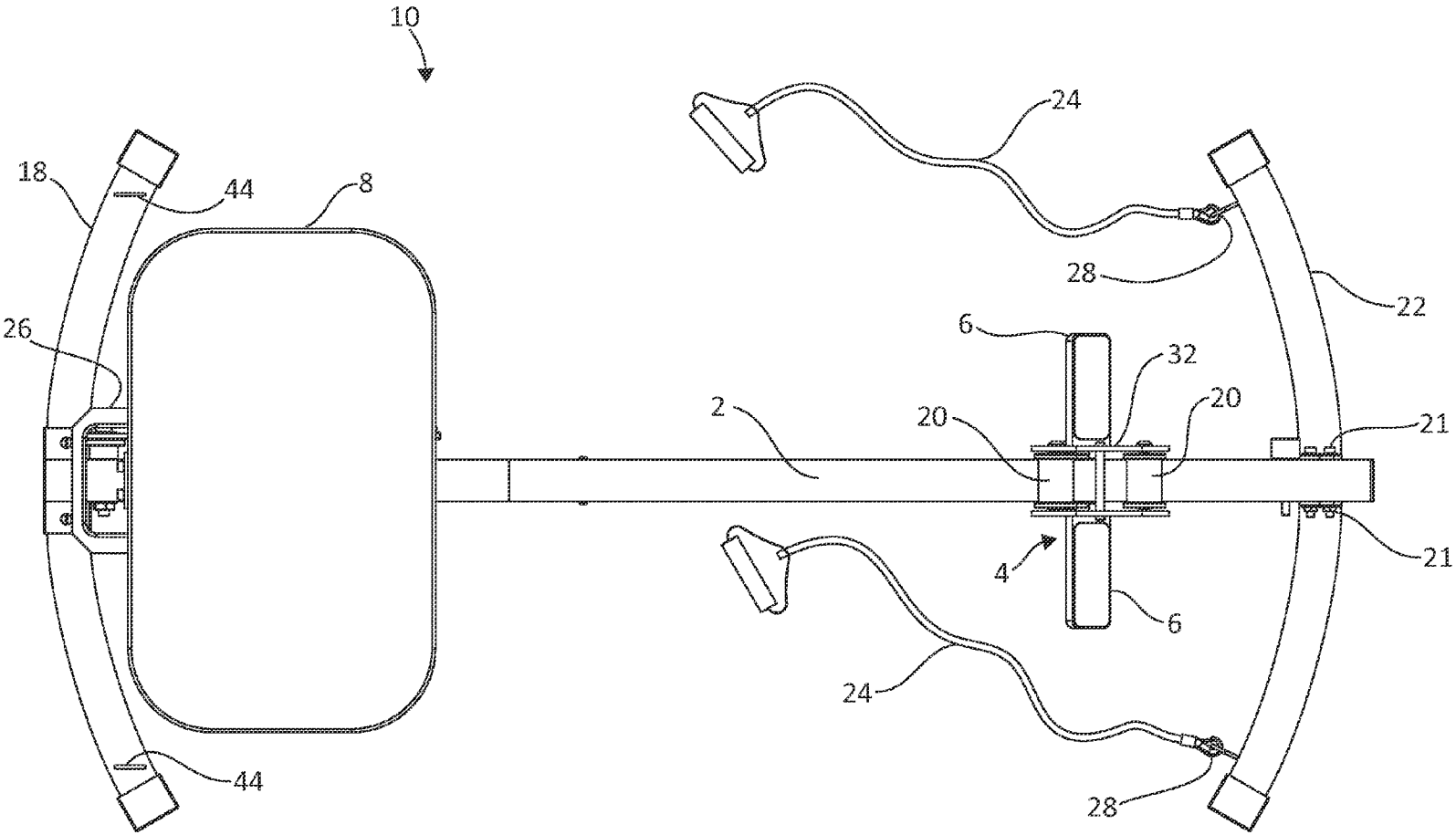
FIG. 4 illustrates an exemplary exercise device according to the present invention from a top view.

Turning to FIG. 4, an exemplary embodiment is depicted from the top view of an exercise device 10. The assembled exercise device 10 illustrates from a top view the top portion of the seat 8 and the seat handle 26 attached to the shaft 2. Further depicted, is the front side of the shaft 2 being attached via a connection device 21 to a front foot 22 for stability and stabilization. The front foot 22 may be straight, curved, or other geometric shape. The hooks 28 are attached to rings 44 which are secured to the either the front foot 22 and rear foot 18, both of which may include the rings 44 positioned at various locations on the front foot 22 or the rear foot 18. The hooks 28 attach to the rings 44 providing the option for flexible hand held cords 24 to be used by the user's hands for additional support, resistance, stability, exercise or other various needs for using the exercise device 10. The flexible hand held cords 24 may include a variety of handles commonly used in the art for providing a structure that holding or connecting to a rope. The flexible hand held cords 24 may be designed with differing strengths, lengths, materials, and resistance capabilities. The flexibility hand held cords 24 may easily attach and be removed from the rings 44 using the hooks 28. Additional features, as described in earlier figures, are also depicted as illustrated examples.

Figure 5:
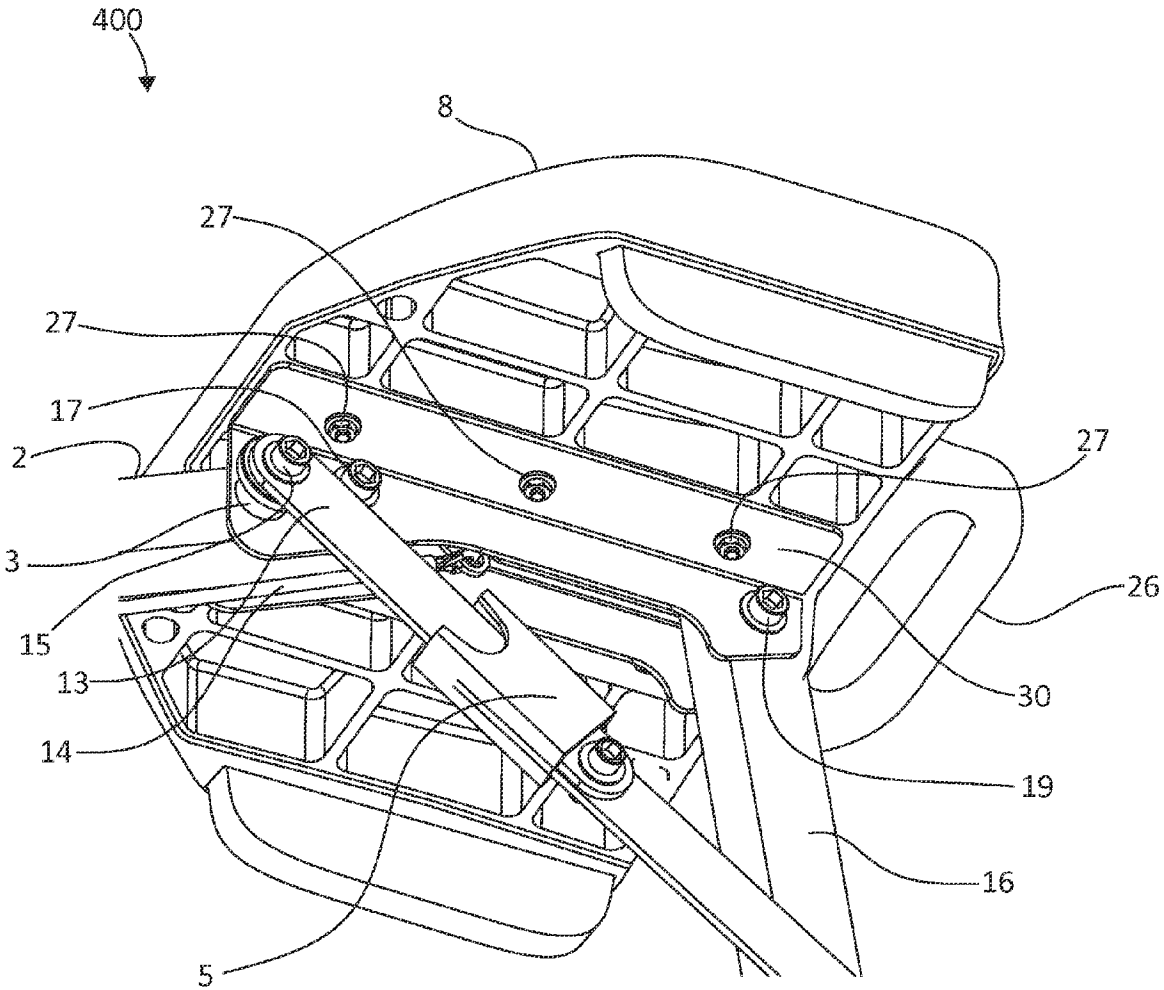
FIG. 5 illustrates an exemplary exercise device according to the present invention of a substantially planar surface seat connected to the shaft from a three dimensional bottom view.

Turning to FIG. 5 an exemplary embodiment depicts a three-dimensional view lower and back view of seat 8 connected to the shaft 2. As depicted in this example, the seat 8 has two substantially planar or horizontal surfaces; a top surface for seating upon the exercise device 10 and a bottom surface for connecting to the shaft 2. As illustrated from the back view looking at the bottom surface of the seat 8, the thickness of the seat 8 from the top surface to the bottom surface may vary depending upon the type of seat 8. The seat 8 may be made of any type of material for sitting, as commonly used in the art for sitting to accomplish such purpose. The seat 8 may have a handle attached to the rear of the seat 8, either assembled as a separate attachment or may be formed and created as one piece at the time of the creation of the seat 8. The bottom surface of the seat 8 is connected to the shaft 2 with two attachment piece 30. Depicted as opposites in construction. The attachment piece 30 may be a separate connective piece used to connect the seat 8 to the shaft 2, or, in the alternative, the shaft 2 and the attachment piece 30 may be constructed as one singular piece.

As depicted in this example, the attachment piece 30 is separate from the shaft 2 and the seat 8. The rear end of the shaft 2 connects to the attachment piece 30 by bolt 15 and bolts 17. The attachment piece 30 is designed with a top surface that is substantially planer and substantially parallel with the seat 8. The attachment piece 30 has two sides that run from end to end, the height or depth of the left side begins to angle downward and longer than on the right side of the attachment piece 30. The angular depth of the longer left side allows the shaft 2 to fit into the attachment piece 30, the angle of the left side being nearly identical with the angle of the shaft 2. The right end of the attachment piece 30 includes additional depth for connecting the attachment piece 30 to the rear beam 16. The attachment piece 30 may connect to the shaft 2 on the left side of the attachment piece 30, the seat 8 on the top surface of the attachment piece 30, and the rear beam 16 on the right side of the attachment piece 30. On the top surface of the attachment piece 30, the seat 8 sits flush with the shaft 2 and is connected to the attachment piece 30 with the connecting bolts 27. The number of connecting bolts 27 may vary with the size, shape, and various dimensions of the seat 8. The attachment piece 30 connects to the rear beam 16 by a bolt 19. The attachment piece 30 and the seat 8 may be constructed and positioned allowing the option of adding an additional pulley under the seat 8. The additional pulley allows the option to connect the flexible cord 14 to the front foot 22 in a fixed position. For example, the flexible cord being connected to the front foot 22 may connect to the additional pulley under the seat. The additional pulley provides the flexible cord 14 to travel back down along the shaft 2 and attaching to the trolley 4. Reversing the attachments of the flexible cord 14 provides the capabilities for the user to start the trolley 4 near or at the top of the shaft. The user may then push downward on the peg 6 of the trolley 4 towards the ground with resistance to the person legs. Additional features, as described in earlier figures, are also depicted as illustrated examples.

Figure 6A:
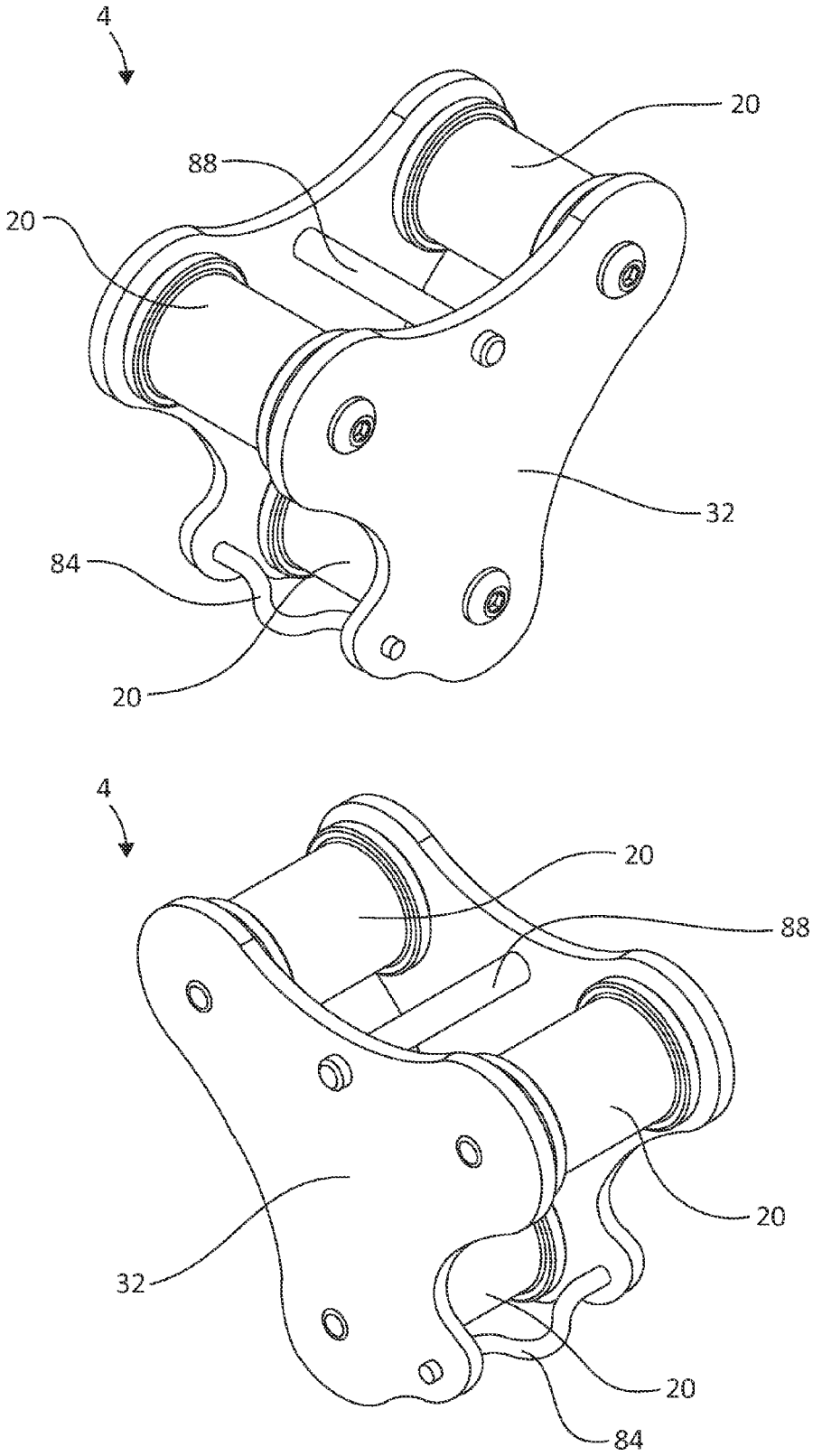
FIG. 6A illustrates an exemplary exercise device of a trolley according to the present invention from a three-dimensional side view.
Figure 6B:
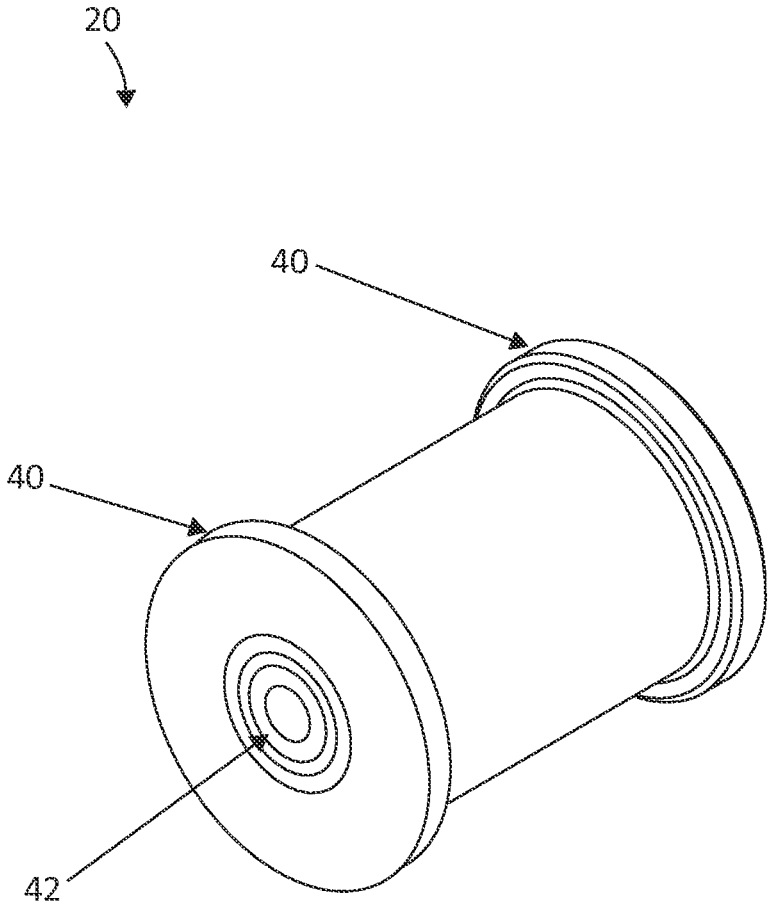
FIG. 6B illustrates an exemplary wheels for a trolley according to the present invention from a three dimensional view.

Turning to FIGS. 6A and 6B, an exemplary embodiment depicts a three-dimensional view a trolley 4 and the wheels of the trolley 4. The embodiment in FIG. 6A illustrates one example of the trolley 4 assembled together with the wheels 20 attached, and in FIG. 6B one example illustrates the wheels 20 of the trolley 4.

Turning to FIG. 6A, in the depicted embodiment the trolley 4 is formed by using two vertical plates 32 and three wheels 20. The vertical plates 32 may be designed using a variety of shapes, sizes, and materials, commonly known in the art to accomplish such purpose. One useful option may include the vertical plates 32 to be designed so the upper portion of the vertical plates 32 may connect or attach the two wheels 20 to each end of the upper portion of the vertical plates 32. In the center of the upper portion of the vertical plates 32 a structural pin 88 may be inserted for structural integrity, support, and stabilization of the trolley 4. The structural pin 88 may be a separate piece or may be a designed and manufactured as one singular piece; the two vertical plates 32 and the structural pin 88 being one singular piece with the wheels 20 to be attached separately.

Each of the vertical plates 32 may include openings for the wheels 20 and the structural pin 88 to be attached with any pin, bolt, peg, nail, screw, dowel, shaft, drill blank, or any other connective device commonly used in the art to accomplish such purposes. This method of attachment may be either temporary such as bolt and nut or permanent such as welding or a press fit. The vertical plates 32 may include a third wheel 20 to be attached and connected to the lower portion of the vertical plates 32. The wheels 20, being connected to the upper portion of the vertical plates 32, may span the width of the top portion of the shaft 2 and assist in rolling the trolley 4 along the shaft 2. The wheels 20, being connected to the lower portion of the vertical plates 32, may roll along the bottom of the shaft to assist the trolley 4 moving along the shaft 2. Alternatively, the wheels 20 connecting to the bottom portion of the vertical plates 32 may also assist the flexible cord 14 by serving as an additional pulley for the flexible cord 14. For example, depending upon the amount of weight placed upon the trolley 4, the wheels 20, connected to the lower portion of the vertical plates 32, may not touch or roll along the shaft 2. Rather, sufficient spacing exits between the bottom of the shaft 2 and the bottom wheels 20 of the trolley 4. The wheels 20 on the bottom portion of the vertical plates 32 may be free spinning acting as a pulley for the flexible cord 14; the bottom wheels 20 of the trolley 4 may be spinning in the same direction as the flexible cord 14 and opposite the direction of the top wheels 20 of the trolley 4.

The bottom portion of the vertical plates 32 may include a connective pin 84 for attaching the flexible cord 14 to the trolley 4. The connective pin 84 may be a separate piece or may be a designed and manufactured as one singular piece, meaning the two vertical plates 32 and the connective pin 84 being one singular piece with the wheels 20 to be attached separately. The connective pin 84 may be any pin, bolt, peg, nail, screw, or any other connective device commonly used in the art to accomplish such purposes. If the connective pin 84 is a separate piece, the connective pin 84 be removed, interchanged, and replaced. Various tolerance levels may be determined by the type, shape, and durability of the material of the connective pin 84 for supporting and providing resistance to the flexible cord 14. One or multiple flexible cords 14 may be attached to the connective pin 84.

Turning to FIG. 6B, in the depicted embodiment, the wheels 20 of the trolley 4 are more clearly displayed. The trolley 4 may use a total of three wheels 20. The design of the wheels 20 may use three double-flanged wheels for the trolley 4 spanning the width of the shaft 2. The wheels 20 may be a spool design with a variety of materials for minimizing rolling resistance while providing support for the trolley 4. The wheels 20 may have wheel edges 40 that are higher on the sides than in the center of the wheels 20. The material for the wheels may include, but not limited to, plastic, fiber, fiberglass, carbon fiber, composite, polymers, sponge, metal, or any other type of material or combination of materials commonly know in the art for a wheels to accomplish such purposes. The wheels 20 may include a center piece 42, which may include more than one bearing, bushings, or other devices for assistance in rolling as commonly used in the art. Such designs may eliminate tolerance stacking and simplifies fabrication and assembly costs. The wheels 20 may include a center opening for a pin, screw, bolt, or other device commonly used in the art. The wheels 20 may be machined inside to various tolerances and bearing depths. One useful example may include the bearings positioned inside of the wheels 20 adapted to avoid riding on the threads of a bolt or pin to prevent fretting.

Figure 7:
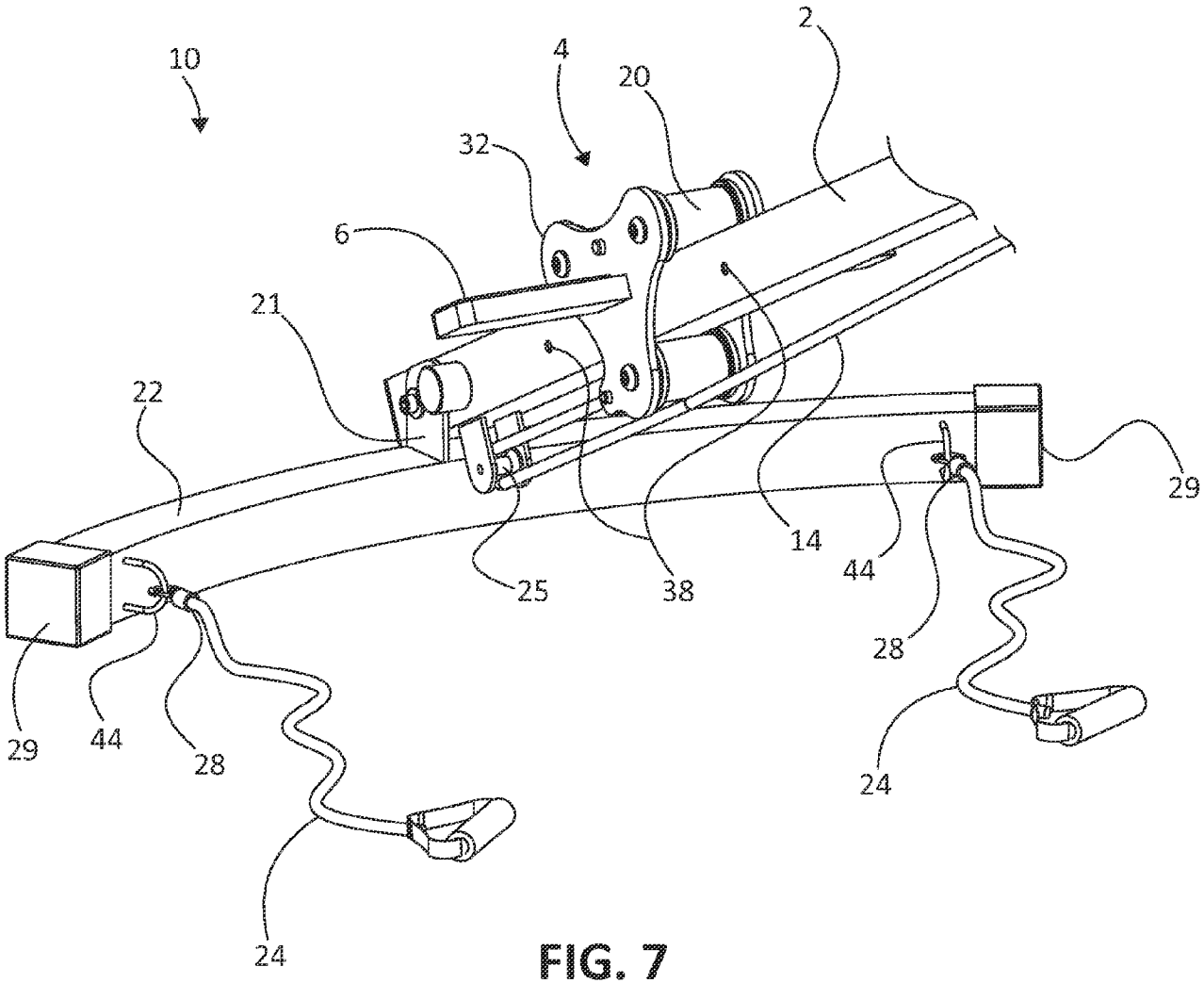
FIG. 7 Illustrates an exemplary trolley and shaft from a three-dimensional view of the bottom according to the present invention.

Turning to FIG. 7, in the depicted embodiment the trolley 4, shaft 2, and the front foot 22 are more clearly displayed. In one embodiment, the shaft 2 has a front end. The front end is attached via a connection device 21 to a front foot 22 for stability and stabilization. The connection device 21 may include angled brackets, mounting clamps, or other type of connection devices known in the art for attaching structures together, and may be a separate component or as a permanent structure to either the shaft 2 or the front foot 22.

In one embodiment, the peg 6 allows the user to place on, beneath, inside, above, or securely fix the users feet to the peg 6 to pull or push the trolley 4 along the shaft. The peg 6 may include attachment devices, such as Velcro®, straps, pedals, or other devices to fix to users feet onto the peg 6. One useful option may include the shaft 2 angled upwards towards the user, and with the users feet on the peg 6 of the trolley 4, pull the trolley 4 along the shaft 2 upwards along the shaft 2 until the trolley 4 reaches a desired ending position or the top of the shaft 2. Once the trolley 4 is at the peak or furthest closest position to the user, the trolley 4 may stop and roll down the angled shaft 2 to the original starting position for another repetition. For example, the trolley 4 may roll down the shaft by gravity, the flexible cord 14, the users feet, or a combination of gravity, the flexible cord 14, and the users feet. The flexible cord 14 is more clearly depicted in wrapping around the pulley 25. If needed, the flexible cord 14 may also use the lower wheels 20 of the trolley to assist as an extra pulley.

Hooks 28 are attached to rings 44 which are secured to the front foot 22 and rear foot 18. The hooks 28 attach to the rings 44 providing the option for flexible hand held cords 24 to be used by the user's hands for additional support, resistance, stability, exercise or other various needs for using the exercise device 10. The end caps 29 are more clearly depicted as they connect semi permanently or permanently to the front foot 22. Additional features, as described in earlier figures, are also depicted as illustrated examples.

Figure 8:
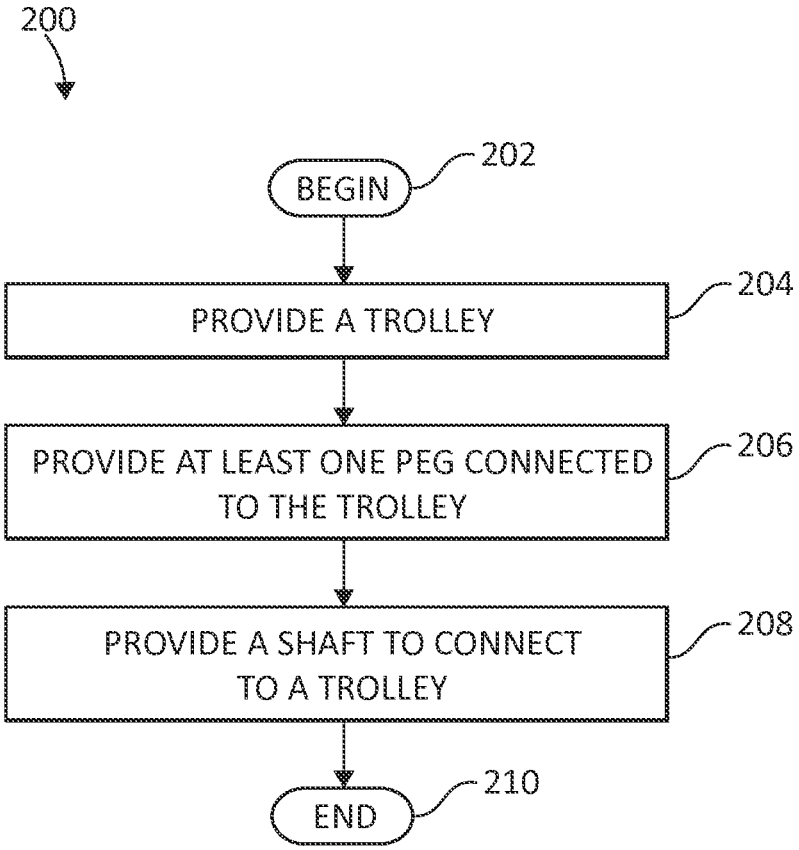
FIG. 8 illustrates a flow chart diagram of an exemplary method for manufacturing an exercise device with a trolley.

FIG. 8 depicts one exemplary method 200 of manufacturing an exercise device. The method of manufacturing begins (step 202) with providing a trolley 4 (step 204). As a next step, at least one peg is provided connected to the trolley 4 (step 206). As a final step, a shaft is provided connected to the trolley 4 (step 208). The method 200 then ends (step 210).

While one or more embodiments of the present invention have been illustrated in detail, the skilled artisan will appreciate that modifications and adaptations to those embodiments may be made without departing from the scope of the present invention as set forth in the following claims.

What is claimed is:

1. An exercise device, comprising:

a trolley adapted to be pulled towards a user while the user is in a seated position, the trolley comprising:

at least two vertical plates with a first and a second side, at least three wheels with a first and a second end, the first and the second end of the at least three wheels being connected to the at least two vertical plates, and at least one peg connected to the trolley, the at least one peg adapted to make contact with at least a portion of the user's foot;

a shaft having a first and a second end, the shaft supported in an angled position accommodating the trolley; wherein the trolley is adapted to be pulled along the shaft towards the user while the user is in a seated position;

a substantially planar surface with a top surface connected to the shaft; and a collapsible beam connected to the shaft, the collapsible beam supporting the shaft in the angled position while the collapsible beam is extended, and allowing the shaft to return to a collapsed position when the collapsible beam is folded to allow the exercise device to be stored in a substantially horizontal position.

2. The device of claim 1, wherein:

the trolley structure is connected to the shaft by coupling means, the least two vertical plates are positioned parallel to the shaft, the at least three wheels are connected to the at least two vertical plates, the at least three wheels span the shaft for rolling along the shaft, and the shaft is adapted with a plurality of openings to insert a locking pin allowing the trolley structure to start from a plurality of positions along the shaft.

3. The device of claim 1, wherein at least one flexible cord is adapted to provide resistance to the trolley, the at least one flexible cord is connected to the trolley structure and a pulley at the first end of the shaft and to the second end of the shaft, the at least one flexible cord is adapted to use one of the at least three wheels on the trolley structure to act as a pulley.

4. The device of claim 1, wherein the substantially planar surface includes:

a opening for holding onto the substantial planar surface;

a top surface, the top surface adapted for the user to sit in the seated position on the substantially horizontal surface; and a bottom surface, the bottom surface connecting to the shaft.

5. The device of claim 1, wherein the first end of the shaft connects substantially perpendicular to a first elongated base member and the shaft being connected to a second elongated base member, the second elongated base member supporting the shaft in an angled position.

6. The device of claim 1, wherein the collapsible beam is adapted with a center joint to return the angled shaft to one of the angled position and one of the collapsed position, the collapsible beam is adapted with a locking slider device to prevent the collapsible bar form collapsing.

* * * * *